US005486000A

United States Patent [19]

Chorne

[11] Patent Number: 5,486,000

[45] Date of Patent: Jan. 23, 1996

[54] WEIGHTED GOLF IRON CLUB HEAD

[76] Inventor: Robert Chorne, 99 Russell Pl., Freeport, N.Y. 11520

[21] Appl. No.: 173,056

[22] Filed: Dec. 27, 1993

Related U.S. Application Data

[63] Continuation-in-part of Ser. No. 886,173, May 21, 1992, Pat. No. Des. 343,216, Ser. No. 729,173, Jul. 17, 1991, Pat. No. 5,186,465, Ser. No. 643,860, Jan. 22, 1991, abandoned, and Ser. No. 469,825, Jan. 24, 1990, Pat. No. Des. 326,130, said Ser. No. 729,173 is a continuation-in-part of Ser. No. 643,860, which is a continuation-in-part of Ser. No. 469,825.

[51] Int. Cl.[6] ..... A63B 53/04

[52] U.S. Cl. ..... 273/169; 273/167 F; 273/167 H; 273/167 A

[58] Field of Search ..... 273/167 R, 77 R, 273/77 A, 167 A, 167 D, 167 E, 167 F, 169, 171, 172, 173, 174, 175, 193 R, 194 R, 194 A, 167 H

[56] References Cited

U.S. PATENT DOCUMENTS

| | | | |
|---|---|---|---|
| 835,735 | 11/1906 | Robertson | 273/167 F |
| 1,917,774 | 7/1933 | Ogg | 273/167 F |
| 2,007,377 | 7/1935 | Link | 273/167 F |
| 2,550,846 | 5/1951 | Milligan | 273/167 A |
| 3,814,437 | 6/1974 | Winquist | 273/167 F |
| 4,621,813 | 11/1986 | Solheim | 273/77 A |

*Primary Examiner*—Sebastiano Passaniti
*Attorney, Agent, or Firm*—F. Eugene Davis, IV

[57] ABSTRACT

For weight distribution in a golf iron club head, the use of construction material from a location thereon never used in play, namely centrally along a top edge of the ball-striking face, advantageously relocated to the toe, sole, heel or combinations thereof, to contribute to sweet spot-enhancement in at least two respects, viz. first, that weight in the removal location is counterproductive to a good hit and removal is a benefit even if not relocated elsewhere, and second that said weight that is relocated being sourced from the club head itself, does not change the overall swing weight of the club head, which typically is selected according to the size and handicap of the golfer and should remain unchanged.

6 Claims, 2 Drawing Sheets

22
24
32
14
20
18
36

32
34
36
18
24
14
26

28
18A
18
22
24
10
30
20
16

10
22
24
14
16
20
26

15
12
10
14
16
20
18

26
14
22

WEIGHTED GOLF IRON CLUB HEAD

This application is a continuation-in-part of my applications: Ser. No. 07/886,173, filed May 21, 1992 entitled GOLF CLUB HEAD and now issued as U.S. Design Patent No. DES. 343,216 on Jan. 11, 1994; Ser. No. 07/729,173, filed Jul. 17, 1991, entitled GOLF CLUB HEAD, now issued as U.S. Pat. No. 5,186,465 on Feb. 16, 1993; Ser. No. 07/643,860, filed Jan. 22, 1991, now abandoned, entitled GOLF CLUB HEAD Of which Ser. No. 07/729,173 was a continuation-in-part; and, Ser. No. 07/469,825 filed Jan. 24, 1990 entitled GOLF CLUB HEAD now issued as U.S. Design Patent No. DES. 326,130 on May 12, 1992 of which Ser. No. 07/643,860 was a continuation-in-part.

The present invention relates generally to improvements in the manufacture and resulting construction of a golf iron club head and, more particularly, to "sweet spot"-enhancement of the ball-striking surface of the club head.

BACKGROUND OF THE INVENTION

In golf iron club head manufacture, it is understood that the club head embodies what, in golf parlance, is known as a "sweet spot" acknowledged to be the medial location of the club head ball-striking inclined surface bounded in a vertical perspective between a top and a bottom edge and in a horizontal perspective between a toe and a heel. Exemplifying this understanding is U.S. Pat. No. 5,110,131 issued to D. Clayton Long on May 5, 1992, and more particularly the discussion in col. 2, lines 39–60. The thrust of the Long patent, and numerous other prior patents, is to contribute to sweet spot-enhancement, usually by an increase in the area thereof, so that the contact of the striking surface with the golf ball occurs in the sweet spot, either directly or in the increased occupied area thereof. It is postulated in this prior patented literature that "A golf club with a larger sweet spot on the striking face helps compensate for an off-center shot by a golfer . . . a reduction of the twisting and other vibrational forms of energy loss experienced from a shot hit on the striking face at a point other than the center of mass" (Long, col. 2, lines 52–54, 57–60).

All known prior art efforts at sweet spot-enhancement contemplate adding weight to the club head in clearance locations to the sweet spot, such as to the left and right thereof in the toe and heel respectively, with the expectation that this will contribute to optimum height in the trajectory and length and direction in the flight of the struck golf ball. While some ball-striking efficacy might result, it is believed that significantly all that occurs is that the overall weight of the club head is increased and the golfer is provided with a heavier golf club to use which, for the size and stature of the golfer and for the golfer's playing ability, might not be appropriate, unless the starting weight of the golf club is selected to factor in the added weight.

Broadly, it is an object of the present invention to provide an improved weighted golf iron club head overcoming the foregoing and other shortcomings of the prior art. More particularly, it is an object to achieve, using weight distribution, sweet spot-enhancement, i.e. significant improvement in the ball-striking efficacy of the club head, while maintaining the same starting overall weight of the club head and, even more important, without detracting from the club head configuration as it relates to its intended end use, namely hitting a golf ball.

SUMMARY OF THE INVENTION

More particularly, and as will be better understood from the succeeding detailed description in which a prior art and a within inventive No. 5 iron are compared to better demonstrate the patentable advance of the latter, the starting weight for the selected construction material is 256 grams and remains as such in the inventive No. 5 iron after weight distribution according to the present invention. In this regard, underlying the present invention is the recognition that in the typical use of a golf club iron the ball is never intentionally struck near or at the top edge of the club face, but always at the "sweet spot" or below, and thus removal of top edge central portion incident to its relocation is totally consistent with the continued use of the golf club iron as intended. By way of further explanation, for example, if the removed club head portion was from the toe, this would certainly adversely affect the use of the golf club iron because a "toe" hit is part of the game, even though possibly never intended, because it can and does occur. In contrast, a "top edge" hit with an iron, for all practical purposes, never occurs.

The description of the invention which follows, together with the accompanying drawings, should not be construed as limiting the invention to the example shown and described, because those skilled in the art to which this invention appertains will be able to devise other forms thereof within the ambit of the appended claims.

BRIEF DESCRIPTION OF THE DRAWINGS

FIG. 1, more particularly, is a perspective view of the prior art iron club head in attached relation to a shaft and constituting a golf club;

FIGS. 2, 3, 4, 5 and 6 are isolated illustrations of the prior art iron club head respectively in plan, front elevation, right side elevation, rear and bottom views.

DETAILED DESCRIPTION OF A PREFERRED EMBODIMENT

Figures 1, 2, 3, 4, 5, 6:
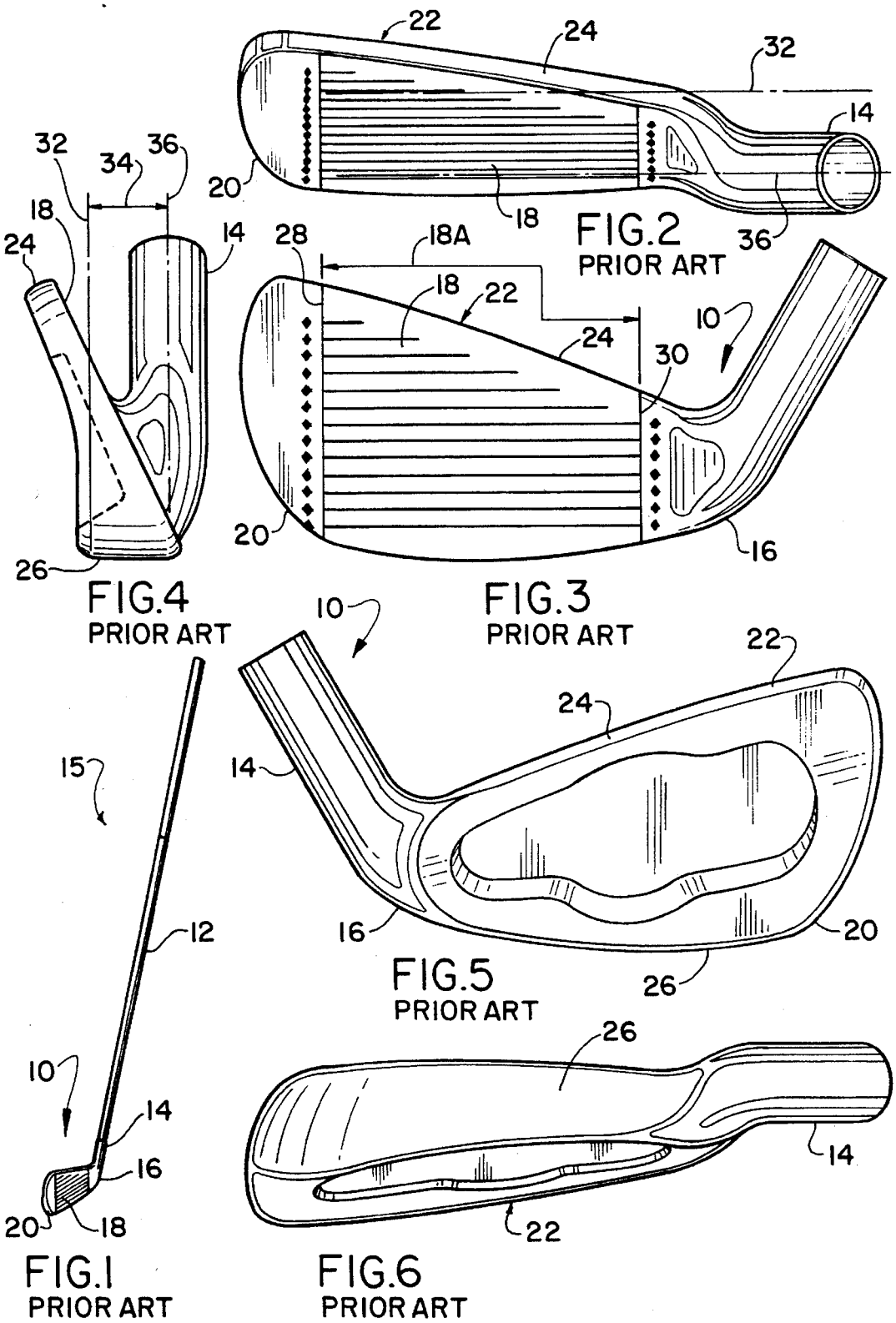
FIG.2 PRIOR ART
FIG.4 PRIOR ART
FIG.3 PRIOR ART
FIG.5 PRIOR ART
FIG.1 PRIOR ART
FIG.6 PRIOR ART
FIGS. 1–6 are views, at perspectives as specifically subsequently noted, of a prior art No. "5" iron club head which are provided for comparison with views FIGS. 7–11 at the same perspective, but of the within inventive iron club head, also a No. "5"
Figure 7:
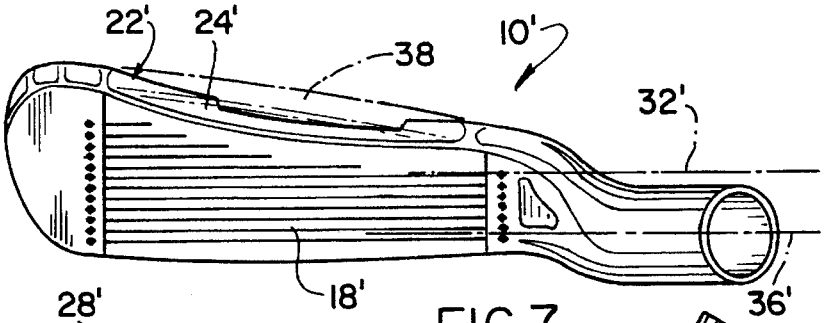
FIGS. 7–11 are isolated illustrations of the within inventive iron club head respectively also for direct comparison with the prior art iron club head of FIGS. 2–6, in plan, front elevation, right side elevation, rear and bottom views.

As is already well known and illustrated in FIGS. 1–6, a typical golf iron club head, generally designated 10, herein selected to be a No. 5, but exemplifying also Nos. 2–9 and specialty golf shot club heads for "chipping", "sand shots" and the like, is assembled at the distal end of a shaft 12 inserted in the hosel 14 to constitute a usable golf club 15. As best understood from the enlarged scale depictions of the iron club head 10 of FIGS. 2–6, the body of the club head includes, in addition to the hosel 14, a heel 16, a central ball-striking inclined face 18 and a toe 20. The actual body 22 presenting the striking surface 18 is typically of metal construction material and bounded by a top edge 24 and a bottom edge 26, and sometimes said face 18, in golf parlance, is referred to as embodying a "sweet spot" particularly the specific area 18A thereof between lines of demarkation 28 and 30 delineating surface 18 from the toe 20 and heel 16.

The medial horizontal orientation of sweet spot area 18A, as best shown in FIG. 4, lies in vertical plane 32 that measures a distance 34, which typically is approximately ½ inch, rearwardly of the vertical plane 36 of the hosel 14. Underlying the present invention is the recognition that the ball-striking efficacy of a golf iron club head is a function of the distance 34 relationship of the planes 32 and 36, wherein the closer the planes 32 and 36 are to each other, the more efficient is the sweet spot 18A as a ball-striking surface.

Reference should now be made to the illustrations of the within inventive golf iron club head as shown in FIGS. 7–11 in which, to enhance an understanding of the patentable differences over the prior art golf iron club head of FIGS. 1–6, the same parts are designated by the same, but primed reference numerals. The significant difference is, as best understood from a consideration of FIGS. 9 and 10, the removal of the metal construction material, or whatever construction material is being used such as metal per se, graphite or the like, as denoted by area 38 illustrated in phantom perspective, from the specifically selected location in the medial length portion of the upper or top edge 24 and relocating this removed weight to a clearance position below area 38 to preferably the sole or rear of the bottom edge 26, said relocation area being more particularly denoted and designated 40. An important consequence is that the distance 34' is significantly reduced between the planes 32' and 36' with attendant efficiency resulting from a sweet spot hit on the golf ball and also, as observed in practice, an improvement in results even with an off-center toe or heel hit of the golf ball.

Figure 9:
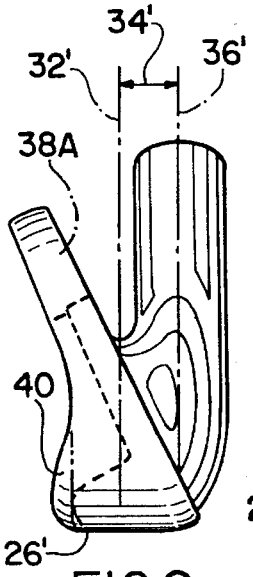
Figure 8:
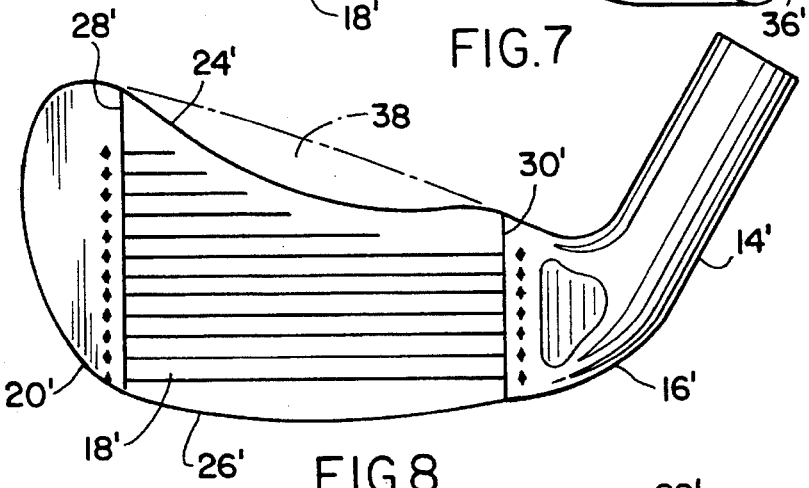
Figure 10:
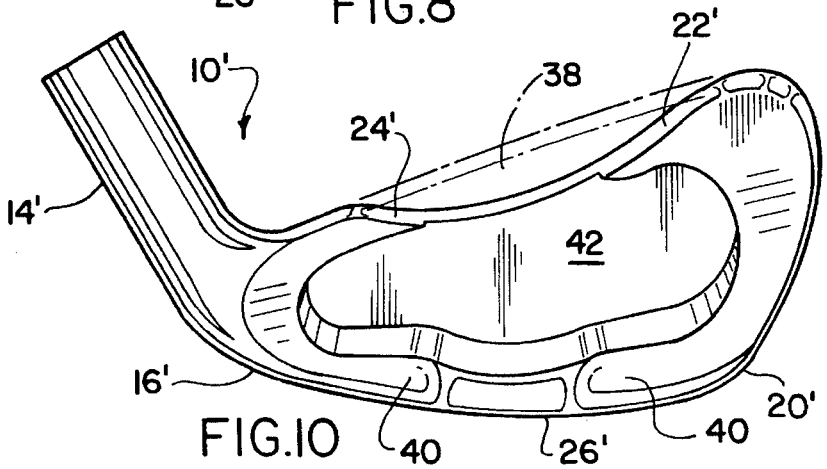
Figure 11:
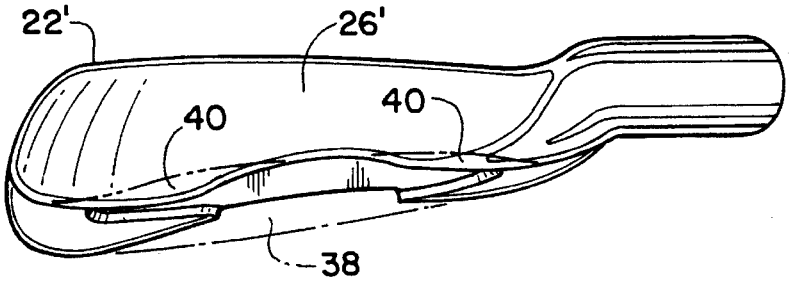

Not only is the removed weight 38 better utilized at location 40 for the ball-striking function intended, but the removal from location 38A noted in FIG. 9 is from the worst location adversely bearing on the efficacy of the club head. To demonstrate this point, it is noted that it is common practice in the manufacture of golf club irons to embody, by removal of construction material, a rear area 42, as best illustrated in FIG. 10, and redistribute the weight occasioned by this removal to other club head areas, such as the heel 16', toe 20', or sole or bottom edge 26'. But this is counterproductive, particularly with respect to the lower region of the recess 42, since said lower region area favorably contributes to locating the sweet spot plane 34' in an optimum position for ball-striking, and thus said lower region area should not have been removed for weight-distribution purposes. The current practice of weight distribution is thus not followed in the manufacture of the within golf club iron 10', and has resulted in a vastly superior ball-striking device.

It should be understood that, while it is within the contemplation of the present invention to always remove the construction material preparatory to weight distribution from the top edge 24', the relocation is not limited to a rear sole location 40, i.e. along the toe, central and heel portions thereof, but can advantageously be at only the toe, only the central portion, only at the heel, and at any combinations of such locations. The selection for removal from the top edge 24' results from the recognition that, in the typical use of a golf club iron, the ball is never intentionally struck near or at the top of the club face 18', but always at the "sweet spot" or below, and thus removal of the top edge central portion incident to its relocation is totally consistent with the continued use of the golf club iron as intended. By way of further explanation, for example, if the removed club head portion is from the toe, this would certainly adversely affect the use of the golf club iron because a "toe" hit is part of the game, even though possibly never intended, because it can and does occur. In contrast, a "top edge" hit with an iron for all practical purposes, never occurs.

While the golf iron club head for practicing the within inventive method, as well as said method herein shown and disclosed in detail, is fully capable of attaining the objects and providing the advantages hereinbefore stated, it is to be understood that it is merely illustrative of the presently preferred embodiment of the invention, and that no limitations are intended to the detail of construction or design herein shown other than as defined in the appended claims.

What is claimed is:

1. In a golf iron club head of a type having a ball-striking body of weight-imparting construction material inclined at a selected angle for driving a struck golf ball a corresponding selected height during its trajectory, said body having spaced-apart top and bottom surfaces bounding a ball-striking surface therebetween, the method of improving weight distribution comprising removing construction material from said top surface, relocating said removed construction material from said top surface to clearance positions below said top surface located adjacent opposite ends of said bottom, surface whereby said removed construction material from a location not used during ball-striking service of said golf iron, is of no adverse consequence thereto and said removed construction material in said relocated positions contributes to increasing said height attained by a struck golf ball.

2. A method of improving the weight-distribution of a selected construction material constituting a golf iron club head with a ball-striking surface bounded in a vertical perspective by top and bottom surfaces and in a horizontal perspective by toe and heel portions said method comprising the steps of removing construction material from a central portion of said top surface, determining the weight of said removed construction material, and embodying as part of selected bottom areas of said toe and heel of said club head said removed construction material having said determined weight, whereby the weight is distributed to said selected bottom area without any increase in the overall weight of the club head.

3. The iron club head of claim 1, wherein said top surface is concave after removal of said material.

4. The iron club head of claim 3, wherein said head comprises toe and heel portions, and said toe portion of said top surface is located farther from said bottom surface than said heel portion of said top surface.

5. The method of claim 2, wherein said top surface is concave after removal of said material.

6. The method of claim 5, wherein said toe portion of said top surface is located farther from said bottom portion than said heel portion of said top surface.

* * * * *